US005197320A

United States Patent [19]

Saegusa

[11] Patent Number: 5,197,320

[45] Date of Patent: Mar. 30, 1993

[54] METHOD OF AND APPARATUS FOR BENDING A METAL TUBE OF A SMALL DIAMETER

[75] Inventor: Shigeru Saegusa, Shizuoka Prefecture, Japan

[73] Assignee: Usui Kokusai Sangyo Kaisha Ltd., Japan

[21] Appl. No.: 736,036

[22] Filed: Jul. 25, 1991

[30] Foreign Application Priority Data

Jul. 26, 1990 [JP] Japan ..... 2-198717

[51] Int. Cl.[5] ..... B21D 7/022; B21D 43/10

[52] U.S. Cl. ..... 72/307; 72/149; 72/217; 72/405; 72/422

[58] Field of Search ..... 72/306, 157, 158, 217, 72/219, 404, 422, 405, 149, 307

[56] References Cited

U.S. PATENT DOCUMENTS

| | | | |
|---|---|---|---|
| 2,810,422 | 10/1957 | Bower . | |
| 3,205,690 | 9/1965 | Roessler . | |
| 3,299,681 | 1/1967 | Hautau | 72/157 |
| 3,553,989 | 1/1971 | Munro et al. . | |
| 4,236,398 | 12/1980 | Schwarze | 72/157 |
| 4,380,917 | 4/1983 | Uchida et al. | 72/150 |
| 4,625,531 | 12/1986 | Lafrasse et al. | 72/150 |
| 4,709,574 | 12/1987 | Horn | 72/422 |
| 4,727,738 | 3/1988 | Yogo | 72/157 |
| 4,732,025 | 3/1988 | Marlinga et al. | 72/150 |
| 4,788,845 | 12/1988 | Schwarze | 72/157 |
| 4,959,984 | 10/1990 | Trudell et al. | 72/154 |
| 5,042,279 | 8/1991 | Togoshi | 72/157 |

FOREIGN PATENT DOCUMENTS

| | | | |
|---|---|---|---|
| 2353028 | 6/1974 | Fed. Rep. of Germany | 72/306 |
| 2746721 | 4/1979 | Fed. Rep. of Germany | 72/157 |
| 2910174 | 9/1980 | Fed. Rep. of Germany | 72/157 |
| 1269879 | 11/1986 | U.S.S.R. | 72/306 |

*Primary Examiner*—Daniel C. Crane

*Attorney, Agent, or Firm*—Anthony J. Casella; Gerald E. Hespos

[57] ABSTRACT

A method of applying various kinds of bending working accurately to a metal tube of a small diameter to be worked, which comprises seizing one end of a metal tube to be worked and setting a working direction, transferring the tube to a working position, applying predetermined bending by paired roller means, transferring the same to the succeeding step and applying the same working. Such operations are repeated as required. The apparatus employed for practicing the method comprises a chuck, a receiving roller and a bending roller and a control means for controlling the operation of them. Various kinds of bending working can be applied efficiently and accurately to a metal tube of a small diameter to be worked by a simple method and with an apparatus of a simple structure.

9 Claims, 10 Drawing Sheets

METHOD OF AND APPARATUS FOR BENDING A METAL TUBE OF A SMALL DIAMETER

BACKGROUND OF THE INVENTION

1. Field of the Invention

The present invention concerns a method of and an apparatus for bending a metal tube of a small diameter.

2. Description of the Prior Art

Bending fabrication to a metal tube of a small diameter has mainly applied by manual operation using a manually operated jig. On the other hand, there have also been used a bending apparatus referred to as a power bender for automatically applying bending to a predetermined shape and a bending apparatus referred to as an NC bender for automatically applying various kinds of bending working.

When bending is applied manually to a metal tube of a small diameter, no sufficient working accuracy is attained and working efficiency is also poor. The power bender needs a relatively inexpensive installation cost and can overcome the problem in view of working accuracy and efficiency but it can apply bending only in a predetermined shape and it is difficult to cope with the change of the bending shape.

Further, although the power bender can apply complicate working to a metal tube of a small diameter in a short period of time, its structure is complicate, installation cost is expensive and maintenance is troublesome. In addition, setting for the change of working conditions is complicate and time consuming.

OBJECT OF THE INVENTION

The present invention has been achieved in view of the foregoing situation for the bending of a metal tube of a smaller diameter as described above and an object thereof is to provide a method of and apparatus for bending a metal tube of a small diameter capable of applying bending easily and accurately to a metal tube of a small diameter to be worked.

SUMMARY OF THE INVENTION

The foregoing object of the present invention can be attained by a method of bending a metal tube of a small diameter for applying predetermined bending in a predetermined working direction to each of n-number of positions to be worked set in the axial direction of the metal tube of a small diameter to be worked, which comprises a position setting step of moving the metal tube of a small diameter to be worked set to a (n=1) working direction while being chucked at one end and rotated around axial center thereof to a (n=1) unit bending device among n-number of unit bending devices disposed side by side corresponding to the n-number of positions to be worked, a bending step of applying bending at a predetermined angle to the (n=1) position to be worked by the unit bending device and a step of transferring the metal tube of a small diameter to be worked to the succeeding unit bending device, and which comprises transferring the metal tube to the (n=2, - - - , n) unit bending devices successively, and repeating the position setting step and the bending step, thereby applying bending at the n-number of positions in the axial direction to the metal tube of a small diameter to be worked.

Further, the foregoing object of the present invention can be attained by an apparatus for bending a metal tube of a small diameter of applying a predetermined bending in a predetermined working direction to each of n-number of positions to be worked set in the axial direction of a metal tube of a small diameter to be worked, which comprises n-number of chuck means for chucking one end of the metal tube of a small diameter to be worked, setting a predetermined working direction by rotating the metal tube of a small diameter to be worked around the axial center thereof and setting the metal tube of a small diameter to be worked to a predetermined position to be worked by moving the tube in the axial direction thereof, a bending means comprising a receiving roller supporting the working position of the metal tube of a small diameter to be worked and a bending roller rotating by a predetermined angle along the outer circumferential surface of the receiving roller by way of the metal tube of a small diameter to be worked while urging the metal tube to the circumferential surface thereby applying bending to the metal tube of a small diameter to be worked and a control means for controlling the operation of the chuck means and the bending means, in which the control means controls the n-number of unit bending devices each comprising the chuck means and the bending means and disposed side by side and n-number of metal tubes of a small diameter to be worked are successively transferred between each of the unit bending devices applying different bending respectively and applied with bending at n-number of positions to be worked.

In the bending method according to the present invention, unit bending devices are disposed side by side by the number of n. Then, a metal tube of a small diameter to be worked is chucked at one end thereof in a position setting step and the metal tube is rotated around the axial center thereof to set the (n=1) working direction, and the (n=1) working position of the metal tube is moved to a bending position for setting the position. Then, in the bending step, the (n=1) working position is put between a (n=1) receiving roller and a (n=1) bending roller in the (n=1) unit bending device, and the (n=1) bending roller opposed by way of the metal tube to the circumferential surface of the (n=1) receiving roller is rotated by a predetermined angle around the (n=1) receiving roller to apply (n=1) bending to the metal tube, which is then transferred to the succeeding unit bending device. Subsequently, the metal tube is successively transferred with respect to (n=2, - - - , n) and the position setting step and the bending steps thereby applying bending to n-number of positions in the axial direction of the metal tube to be worked.

Further, in the bending apparatus according to the present invention, n-sets of chuck means and bending means are controlled by the control means, in which each of the chuck means chucks one end of a metal tube of a small diameter to be worked, the metal tube to be worked is rotated around the axial center to set a predetermined working direction and the predetermined working position of the metal tube is moved to the bending position. The bending means comprising n sets of receiving rollers and bending rollers are made movable so they are set and released from the setting to the bending position, the metal tube is put between each of the receiving rollers and bending rollers, and each of the bending rollers opposed by way of the metal tube to the circumferential surface of each of the receiving rollers is rotated by a predetermined angle around the receiving roller as the center to apply bending to the metal tube. Subsequently, the metal tube is transferred to the succeeding set of the chuck means and the bending means and applied with similar bending. The foregoing operations are repeated successively hereinafter.

BRIEF DESCRIPTION OF THE ACCOMPANYING DRAWINGS

DESCRIPTION OF THE PREFERRED EMBODIMENTS

The present invention will now be described for the bending apparatus in the preferred embodiments according to the present invention with reference to the drawings.

Figure 1:
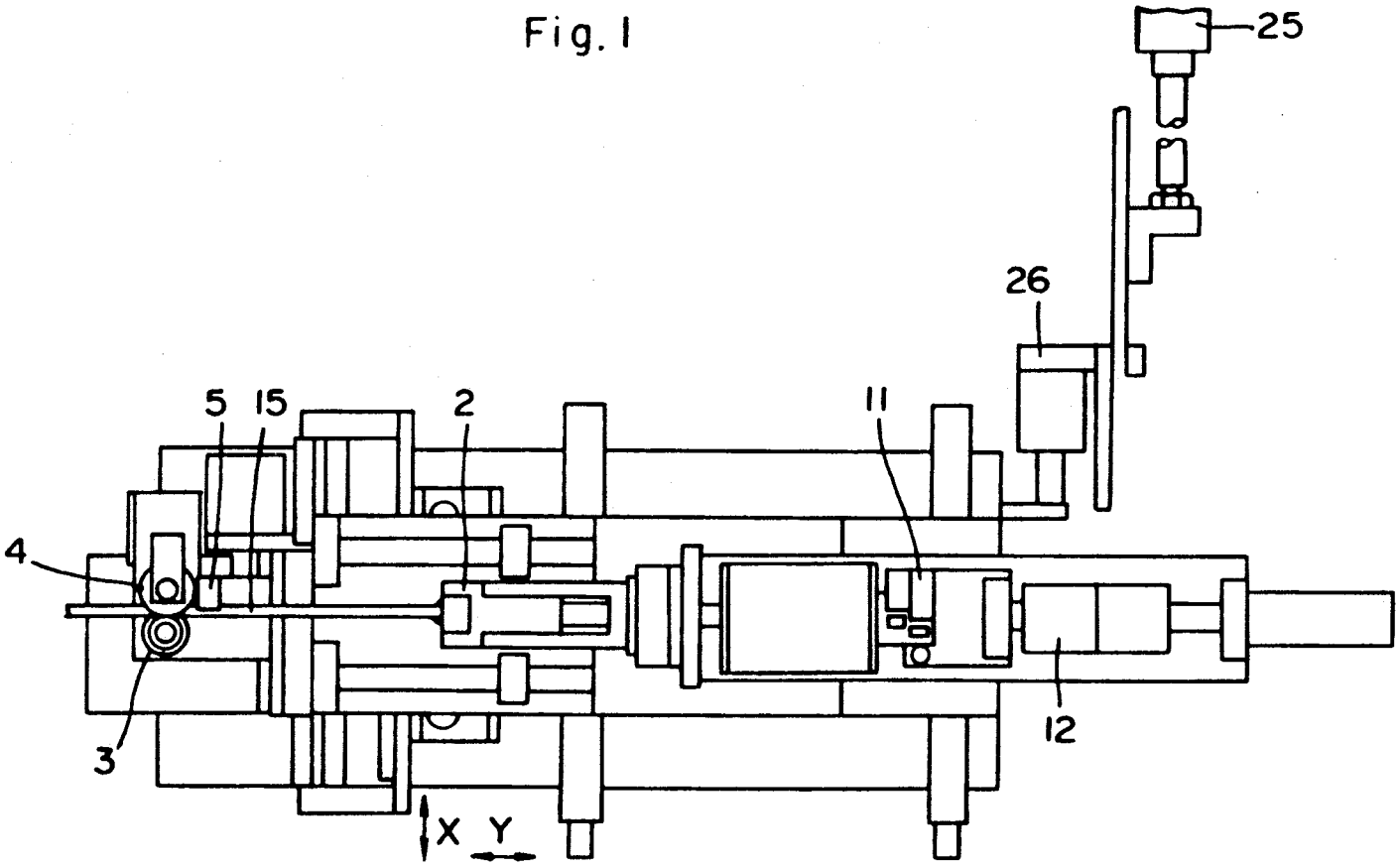
FIG. 1 is a plan view of a unit bending device in an apparatus for bending a small metal tube according to a first embodiment of the present invention.
Figure 2:
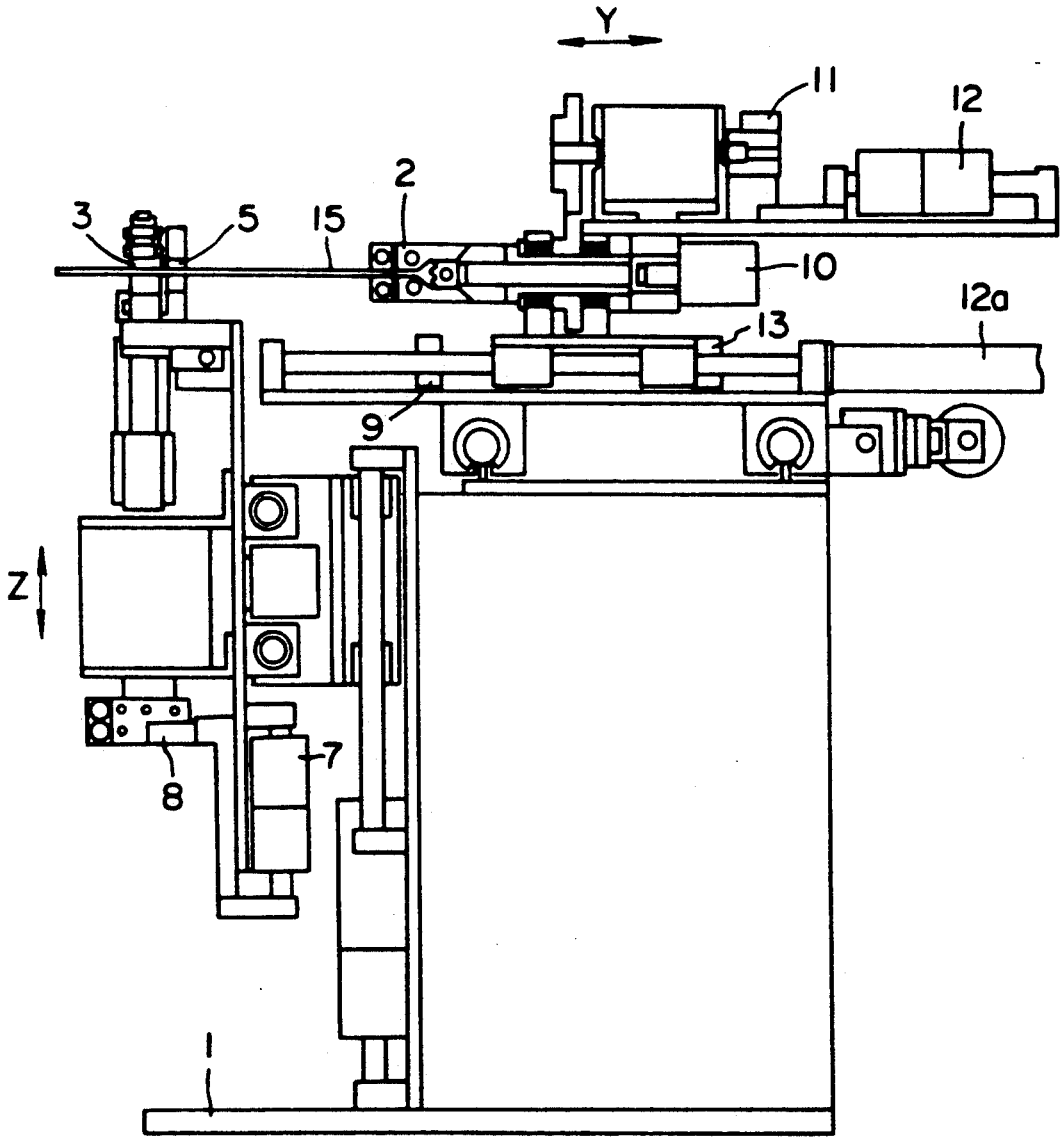
FIG. 2 is a side elevational view of the unit bending device in the apparatus for bending a small metal tube according to the first embodiment of the present invention.
Figure 3:
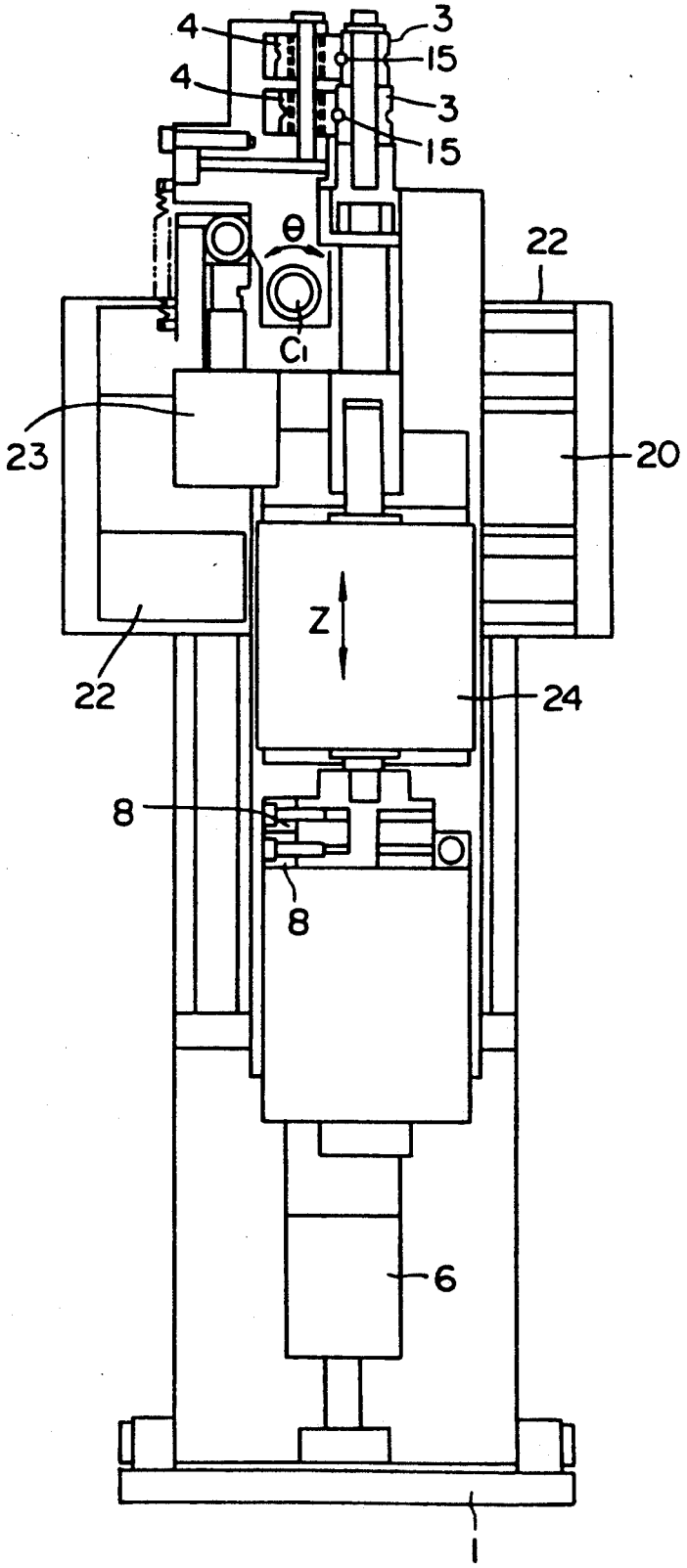
FIG. 3 is a front elevational view of the unit bending device in the apparatus for bending a small metal tube according to the first embodiment of the present invention.
Figure 4:
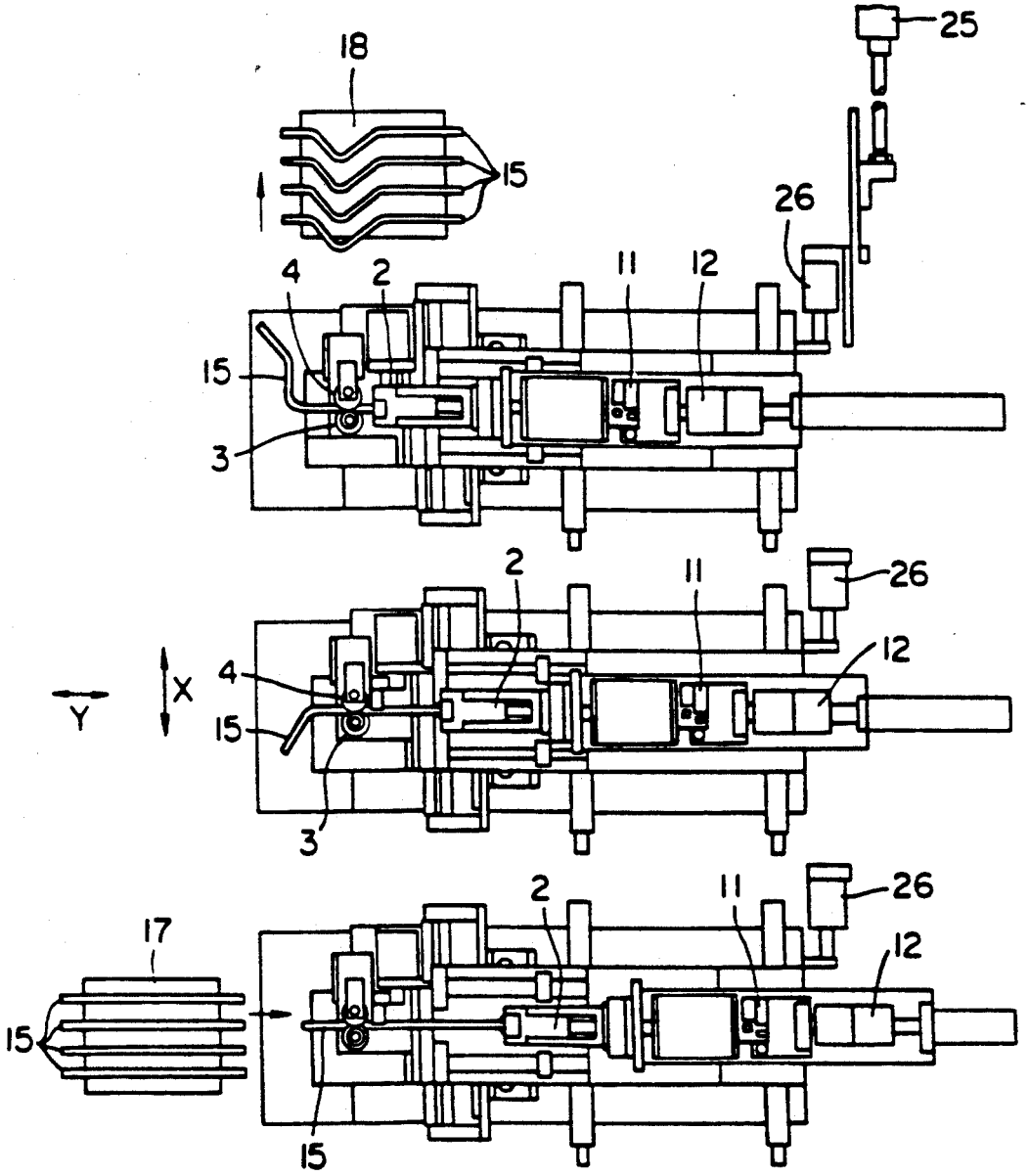
FIG. 4 is a plan view illustrating an entire structure of the apparatus for bending a small tube according to the first embodiment of the present invention.
Figure 5:
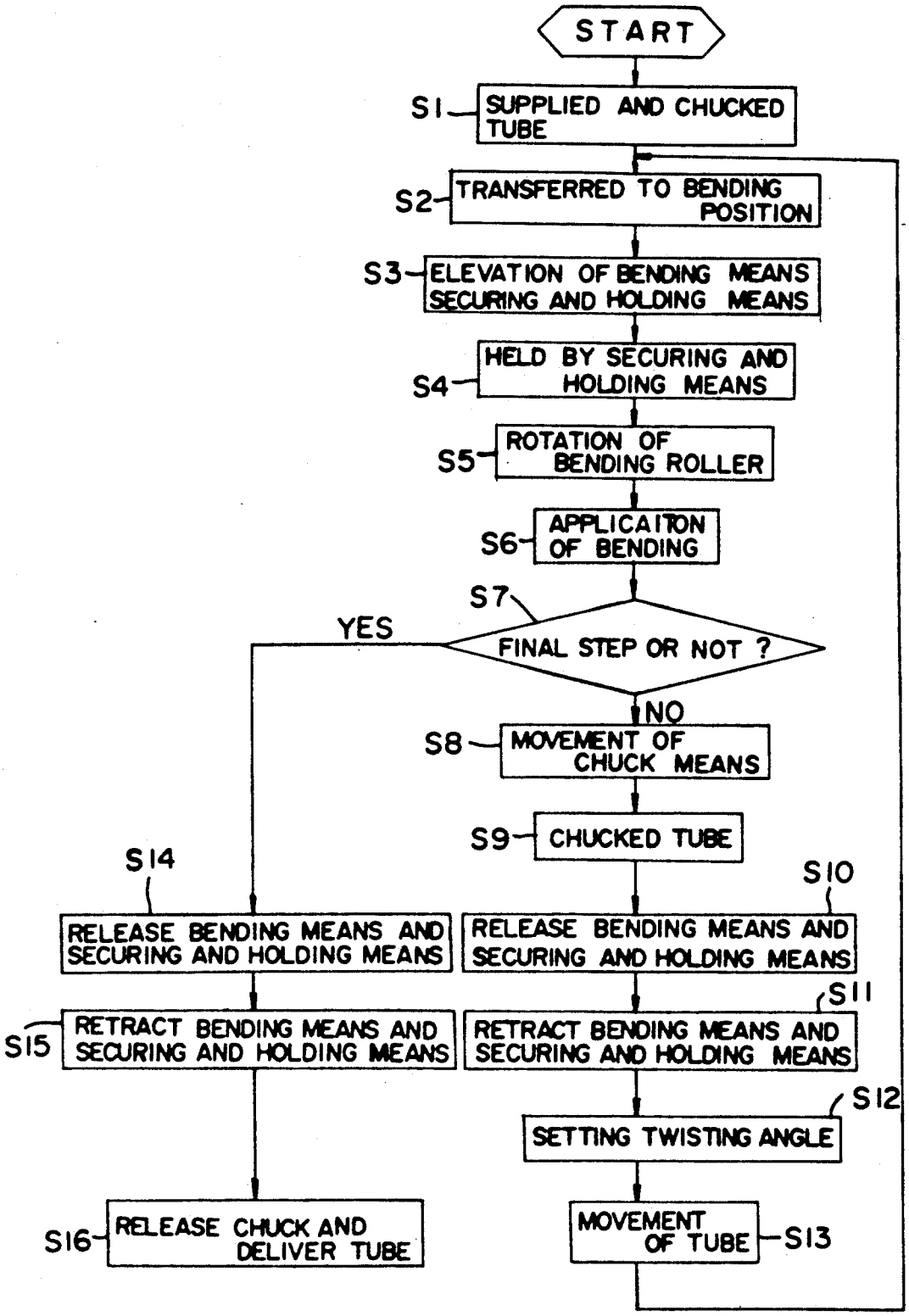
FIG. 5 is a flow chart illustrating the operation of the first embodiment according to the present invention.

FIG. 1 is a plan view of a unit bending device in an apparatus for bending a small metal tube according to a first embodiment of the present invention;

FIG. 2 is a side elevational view of the unit bending device in the apparatus for bending a small metal tube according to a first embodiment of the present invention;

FIG. 3 is a front elevational view of the unit bending device in the apparatus for bending a small metal tube according to the first embodiment of the present invention;

FIG. 4 is a plan view illustrating an entire structure of the apparatus for bending a small tube according to the first embodiment of the present invention;

FIG. 5 is a flow chart illustrating the operation of the first embodiment according to the present invention.

As shown in FIGS. 1 through 3, the unit bending device of the first embodiment comprises a chuck means having a chuck 2 which is movable relative to a substrate block 1 in a horizontal direction (in the direction of arrow X) perpendicular to a metal tube of a small diameter to be worked (hereinafter simply referred to as a work tube) and in a axial direction of the work tube (in the direction of arrow Y in FIGS. 2 and 3), a bending means having a receiving roller 3 which is movable vertically relative to the substrate block 1 (in the direction of arrow Z in FIGS. 2 and 3) and a rotatable bending roller 4 opposed to the circumferential surface of the receiving roller 3 and rotatable around the axial center of the receiving roller 3 and rotatable in the direction of an arrow $\theta$ around an axis $C_1$ in FIG. 3 and a securing and holding means having a pressing die 5 and a control means.

As shown in FIG. 4, three sets of unit bending devices of such a structure are arranged, preferably, each at an equal distance and a feeder 17 for supplying work tubes 15 to the chucks 2 are disposed on one side of the arrangement in the first embodiment. Further, a product receiver 18 is disposed on the other side of the arrangement near the bending means for receiving the work tubes 15 after working.

The chuck 2 in the chuck means has a function of chucking one end of the work tube 15, rotating the chucked work tube 15 around its axial center to set a working direction for or providing a bending plane, as well as moving to the axial direction of the work tube 15 and the horizontal direction (lateral direction) perpendicular to the axial direction and putting the tube between the receiving roller 3 and the bending roller 4 of a predetermined bending means.

The receiving roller 3 and the bending roller 4 of the bending means and the pressing die 5 of the securing and holding means are so adapted that they move in a vertical direction, and put the work tube 15 therebetween, and the bending roller 4 rotates while opposing the circumferential surface of the receiving roller 3 by way of the work tube 15 to apply a predetermined bending at a working position of the work tube 15.

As shown in FIG. 3, in this first embodiment, two vertical sets of mating receiving rollers 3 and bending rollers 4 are selectively disposed, in which the diameters for the receiving rollers and the bending rollers are different between each of the sets, so that working with different radius of bending can be selected. Further, as shown in FIG. 4, three sets of such unit bending devices are disposed each at a predetermined distance side by side such that different bending can be applied respectively by the receiving rollers 3 and the bending rollers 4 of the respective units, and the work tubes 15 is successively transferred to the succeeding unit bending device by the chuck 2 movable in the horizontal direction (lateral direction) on every one step.

The control means comprises a bending angle stopper 8, a bending angle stopper moving cylinder 7, a bending means cylinder 6, a bending position stopper 9, a positioning cylinder 12*a*, a bending position stopper 13, a pipe chucking cylinder 10, a twisting stopper moving cylinder 12, a twisting angle stopper 11, a press cylinder 23, a lateral stopper 22, a lateral cylinder 20, a cylinder 24, a laterally moving cylinder 25 and a cylinder 26 and the control means controls the following operation.

The operation of the first embodiment having thus been constituted will now be explained with reference to the flow chart of FIG. 5.

At step S1 in the figure, a work tube 15 is taken out of the feeder 17 and the supply of the work tube to the bending device is started and one end of the tube is chucked by the chuck 2 of the first unit bending device.

At step S2, the work tube 15 seized by the chuck 2 is transferred to the bending position of the bending means. At step S3, the bending means and the securing and holding means elevate from their retracted position vertically below to the working position and, at step S4, the work tube 15 is secured and held by the pressing die 5 of the securing and holding means.

Then, the operation proceeds to the step S5, in which the bending roller 4 of the bending means rotates around the axis $C_1$ as the center to seize the work tube 15 between the receiving roller 3 and the bending roller 4. At step S6, the bending roller 4 rotates along the circumferential surface of the receiving roller 3 while pressing the work tube 15 to the circumferential surface of the receiving roller 3 to apply first bending. By the first bending, a predetermined bending is applied at the first bending position of the work tube 15 in accordance with the diameter of the receiving roller 3 and the rotating angle of the bending roller 4.

Then, at step S7, it is judged whether the step is a final step or not. In this case, since the step is not final, it is judged as NO and the operation is proceeded to the next step.

At step S8, the chuck means of the second unit bending device moves to the position for the first unit bending device in the horizontal direction of the work tube 15. At step S9, the work tube 15 having applied with the first bending is chucked by the chuck 2 of the chuck means in the second unit bending device. At step S10, the bending means and securing and holding means are released and the work tube 15 is chucked only by the chuck 2 of the chuck means.

At step S11, the bending means and the securing and holding means descend to the retracted position vertically below. Then, at step S12, the chuck 2 rotates around the axial center thereof to the position of the twisting angle stopper 11 set by the twisting stopper moving cylinder 12 to set the bending direction of the second bending to be applied next to the work tube 15.

Then, the operation is proceeded to the step S13 and the work tube 15 having applied with the first bending is moved, while being seized by the chuck 2 of the chuck means in the second unit bending device, to the region of the bending means and the securing and the holding means in the second unit bending device.

Then, the operation is returned to the step S2 and the same steps as already explained are executed by the second bending device to apply second bending at the second working position of the work tube 15. Further, third bending is applied at the third working position to the work tube 15 having applied with the second bending.

In this third step, since it is judged YES in the step S7, the operation is proceeded to and after the step S14 in which the chuck 2 is released and the work tube 15 having applied with the first through third bending is supplied to the product receiver 18.

Description will be made to the second embodiment of the bending apparatus according to the present invention with reference to FIG. 6 through FIG. 10, in which all of the constituent portions carry the reference numerals corresponding to those in the first embodiment each additionally attached with "100".

Figure 6:
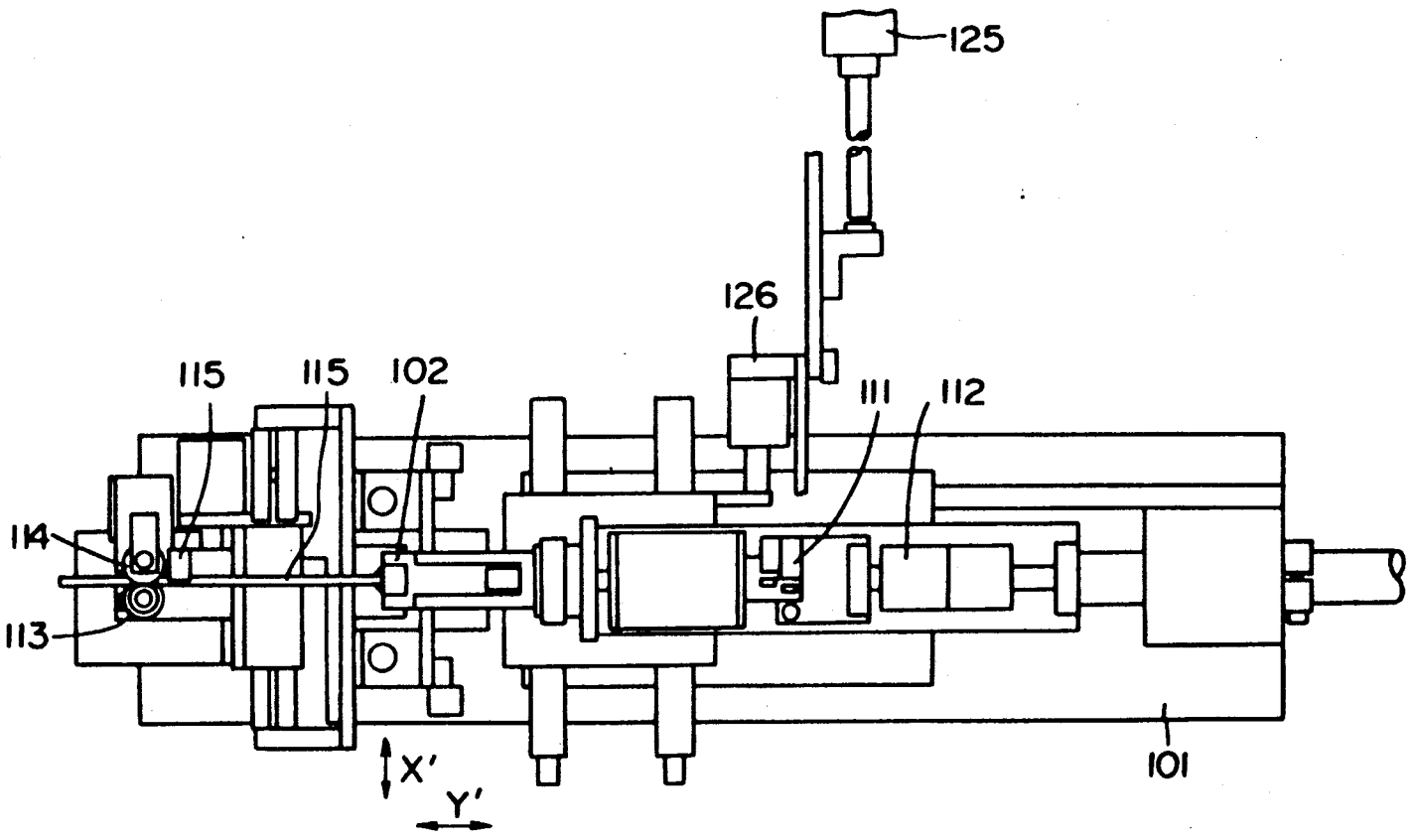
FIG. 6 is a plan view of a unit bending device in an apparatus for bending a small metal tube according to a second embodiment of the present invention.
Figure 7:
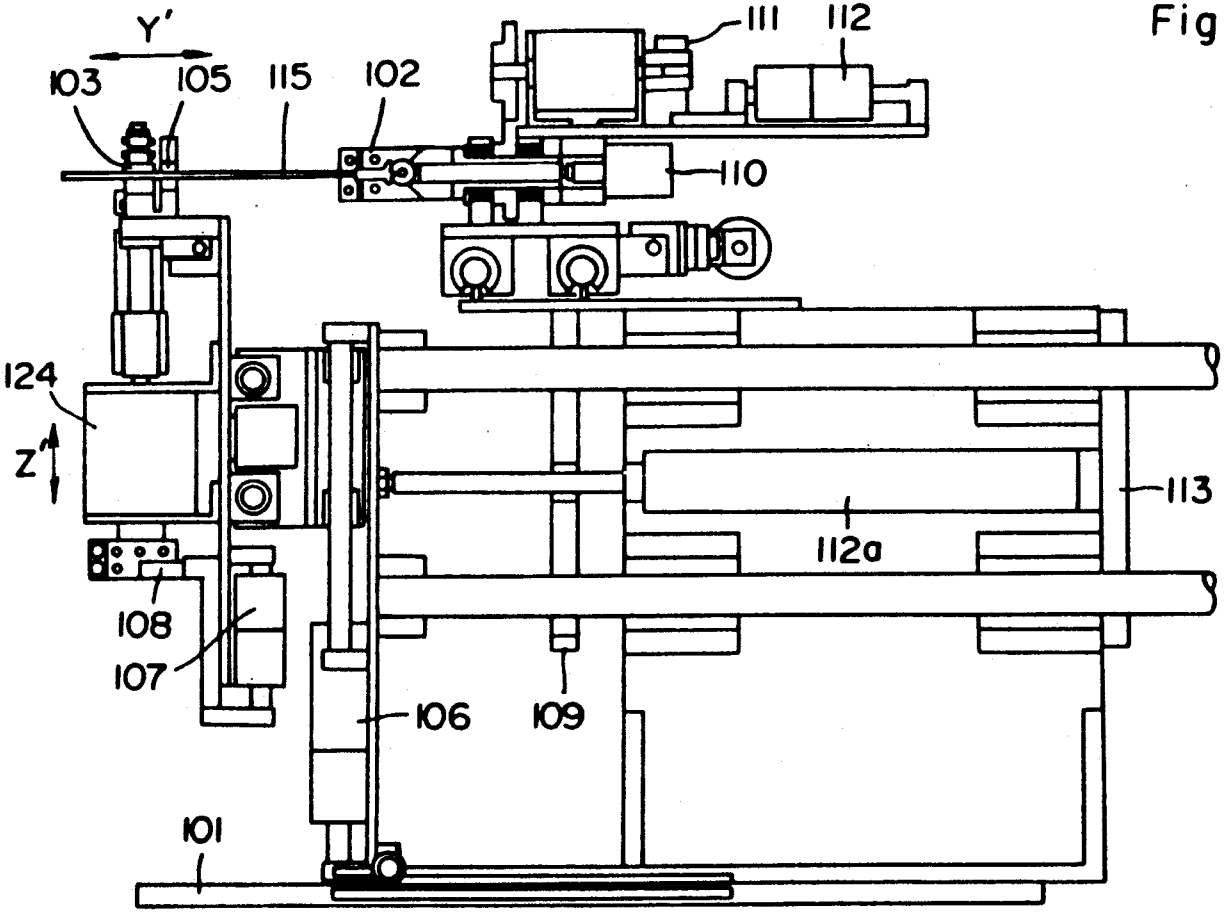
FIG. 7 is a side elevational view of the unit bending device in the apparatus for bending a small metal tube according to the second embodiment of the present invention.
Figure 8:
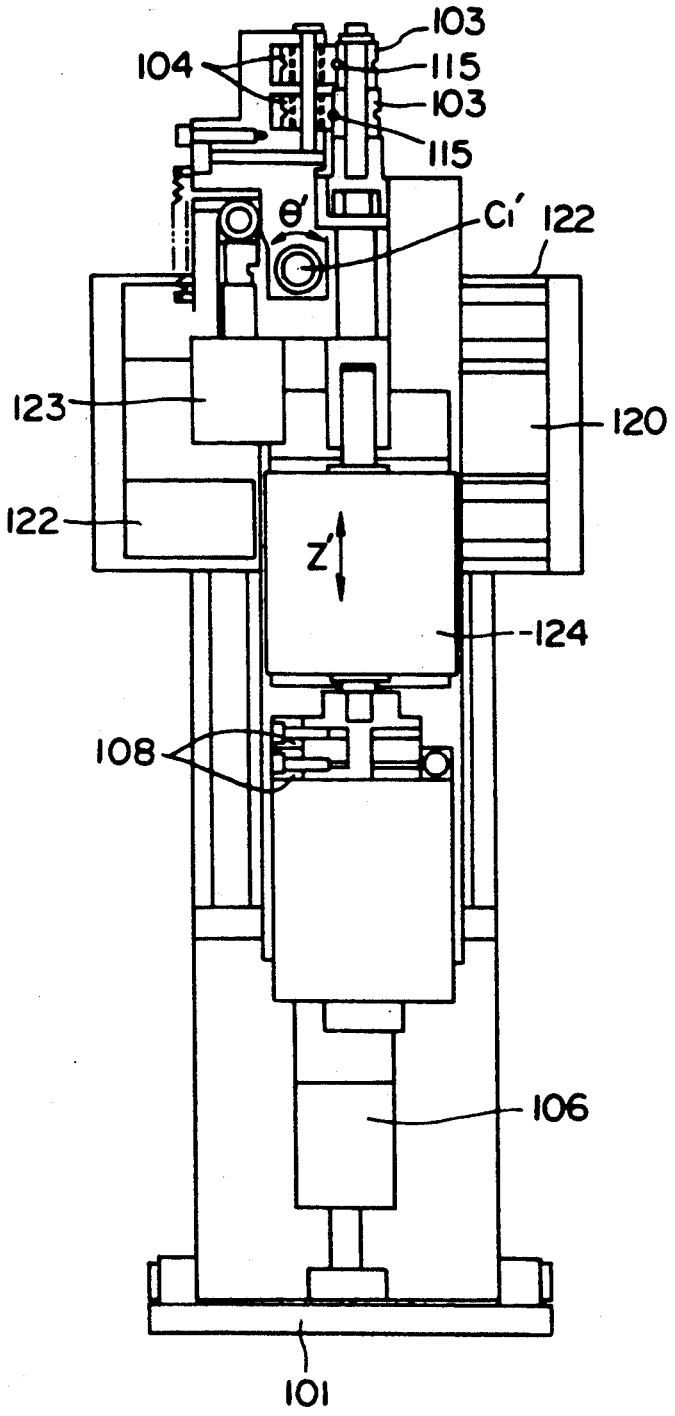
FIG. 8 is a front elevational view of the unit bending device in the apparatus for bending a small metal tube according to the second embodiment of the present invention.
Figure 9:
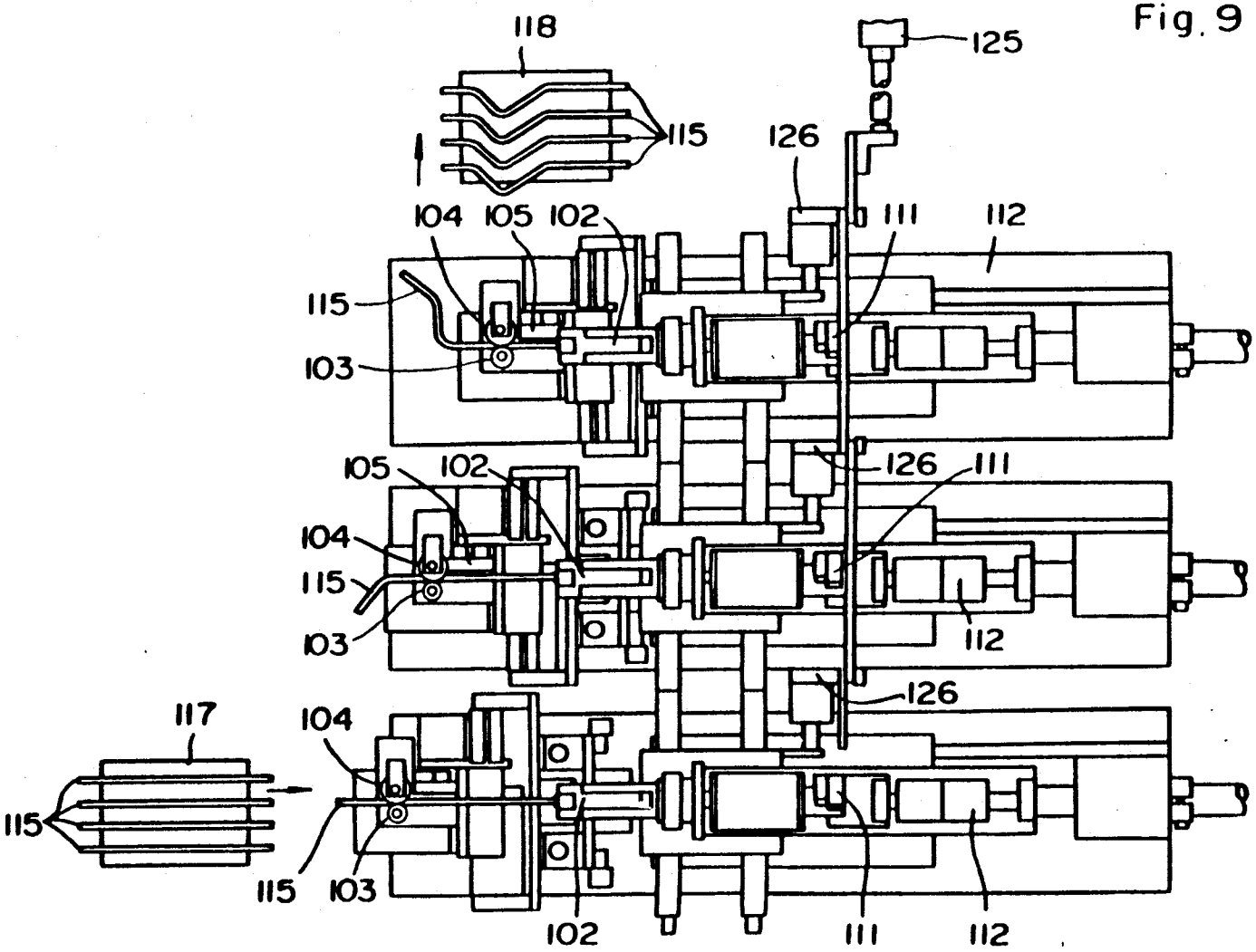
FIG. 9 is a plan view illustrating an entire structure of the apparatus for bending a small tube according to the second embodiment of the present invention.
Figure 10:
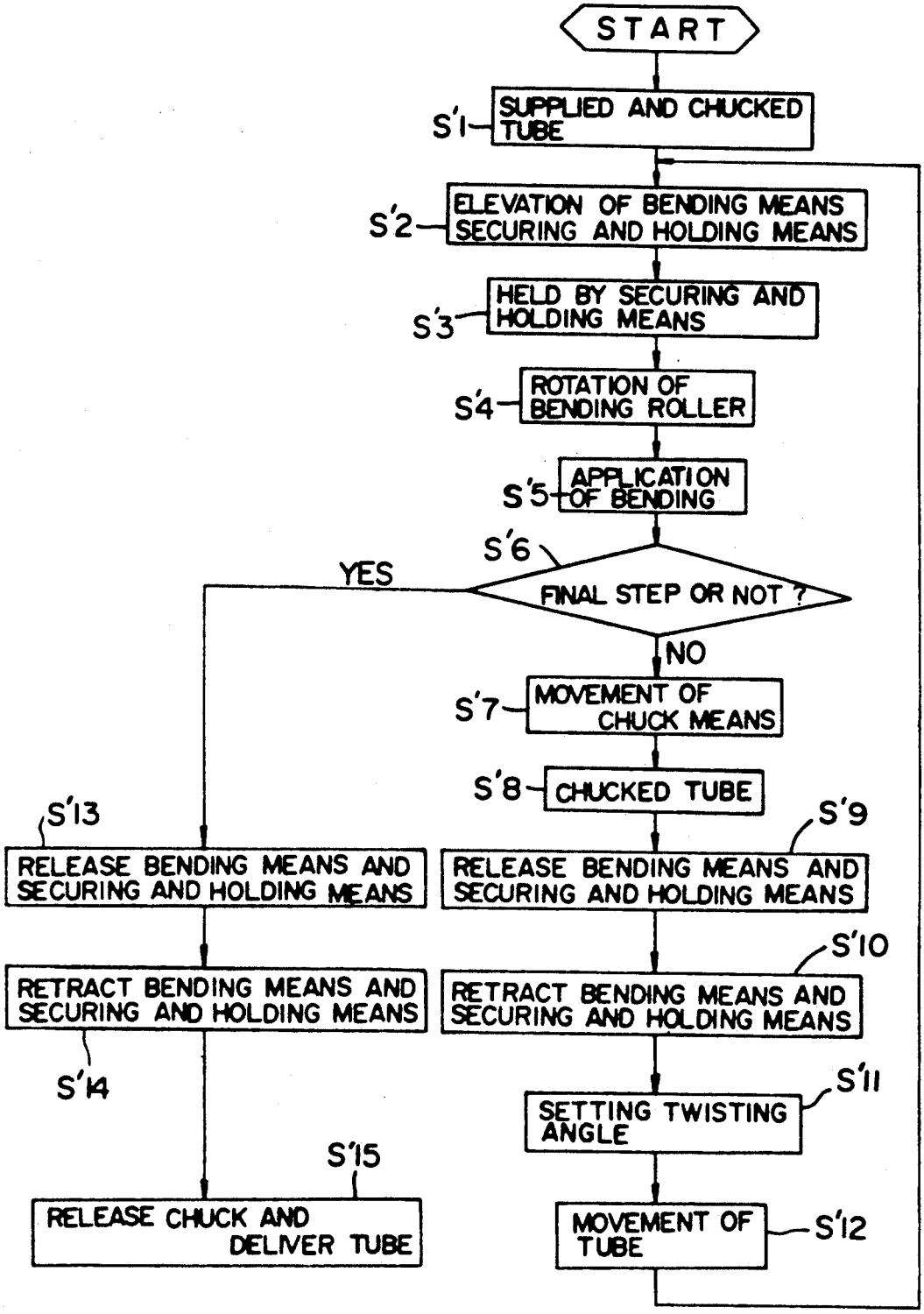
FIG. 10 is a flow chart illustrating the operation of the second embodiment according to the present invention.

FIG. 6 is a plan view of a unit bending device in an apparatus for bending a small metal tube according to a second embodiment of the present invention;

FIG. 7 is a side elevational view of the unit bending device in the apparatus for bending a small metal tube according to a second embodiment of the present invention;

FIG. 8 is a front elevational view of the unit bending device in an apparatus for bending a small metal tube according to the second embodiment of the present invention;

FIG. 9 is a plan view illustrating an entire structure of the apparatus for bending a small tube according to the second embodiment of the present invention;

FIG. 10 is a flow chart illustrating the operation of the second embodiment according to the present invention.

As shown in FIG. 6 through FIG. 8, the unit bending device of the second embodiment comprises a chuck means having a chuck 102 which is made movable relative to a substrate block 101 in a horizontal direction perpendicular to a work tube 115 (in the direction of arrow X' in FIG. 6), a bending means having a receiving roller 103 which is movable relative to the substrate block 101 in a axial direction of the work tube (in the direction of arrow Y' in FIG. 7 and FIG. 8) and vertically relative to the substrate block 101 (in the direction of arrow Z' in FIG. 7 and FIG. 8) and a rotatable bending roller 104 opposed to the circumferential surface of the receiving roller 103 and rotatable around the axial center of the receiving roller 103 and rotatable in the direction of an arrow $\theta'$ around an axis $C_1'$ in FIG. 8 and a securing and holding means having a pressing die 105 and a control means.

As shown in FIG. 9, three sets of unit bending devices of such a structure are arranged, preferably, each at an equal distance line that in FIG. 4 and a feeder 117 for supplying work tubes 115 to the chucks 102 are disposed on one side of the arrangement in the second embodiment. Further, a product receiver 118 is disposed on the other side of the arrangement near the receiving roller and the bending roller 105 of the bending means for receiving the work tubes 115 after working.

The chuck 102 in the chuck means has a function of chucking one end of the work tube 115, rotating the chucked work tube 115 around its axial center to set a working direction for providing a bending plane, as well as moving in the horizontal direction and putting the work tube 115 between the receiving roller 3 and the bending roller 104 of a predetermined bending means.

The receiving roller 103 and the bending roller 104 of the bending means and the pressing die 105 of the securing and holding means are so adapted that they move in a vertical direction, and put the work tube 115 therebetween, and the bending roller 104 rotates while opposing the circumferential surface of the receiving roller 103 by way of the work tube 115 to apply a predetermined bending at a working position of the work tube 115.

As shown in FIG. 8, in this second embodiment like that in the first embodiment, two vertical sets of mating receiving rollers 103 and bending rollers 104 are selectively disposed, in which the diameters for the receiving rollers and the bending rollers are different between each of the sets, so that working with different radius of bending can be selected. Further, as shown in FIG. 9, the position for opposing the receiving roller 103 and the bending roller 104 of the bending means in each of the bending devices is different little by little in the extending direction of the work tube 115 between each of the unit bending devices, and each of the working positions for the work tube 115 is seized on each of the unit bending devices. The position is made movable on each of the unit bending devices and can be set at a desirable position.

The control means comprises a bending angle stopper 108, a bending angle stopper moving cylinder 107, a bending means cylinder 106, a bending position stopper 109, a positioning cylinder 112*a*, a bending position stopper 113, a pipe chucking cylinder 110, a twisting stopper moving cylinder 112, a twisting angle stopper 111, a press cylinder 123, a lateral stopper 122, a lateral cylinder 120, a cylinder 124, a lateral moving cylinder 125 and a cylinder 126.

The operation of the second embodiment having thus been constituted will now be explained with reference to the flow chart of FIG. 10.

At step S'1 in the figure, a work tube 115 is taken out of the feeder 117 and the supply of the work tube to the bending device is started and one end of the tube is chucked by the chuck 102 of the first unit bending device 102. At step S'2, the bending means and securing and holding means elevate from the retracted position vertically below to the working position and, in step S'3, the work tube 115 is secured and held by the pressing die 105 of the securing and holding means.

Then, the operation proceeds to step S'4 in which the bending roller 104 of the bending means rotates around the axis $C_1'$ as the center to seize the work tube 115 between the receiving roller 103 and the bending roller 104. At step S'5, the bending roller 104 rotates along the circumferential surface of the receiving roller 103 while pressing the work tube 115 to the circumferential surface of the receiving roller 103 to apply first bending. By the first bending, a predetermined bending is applied at the first working position of the work tube 115 in accordance with the diameter of the receiving roller 103 and the rotating angle of the bending roller 104.

Then, at step S'6, it is judged whether the step is a final step or not. In this case, since the step is not final, it is judged as NO and the operation is proceeded to the next step.

At step S'7, the chuck means of the second unit bending device moves to the position for the first unit bending device in the horizontal direction of the work tube 115. At step S'8, the work tube 115 having applied with the first bending is chucked by the chuck 102 of the chuck means in the second unit bending device. At step S'9, the bending means and securing and holding means are released and the work tube 115 is chucked only by the chuck 102 of the chuck means.

At step S'10, the bending means and the securing and holding means descend to the retracted position vertically below. Then, at step S'11, the chuck 102 rotates around the axial center thereof to the position of the twisting angle stopper 111 set by the twisting stopper moving cylinder 112 to set the bending direction of the second bending to be applied next to the work tube 115.

Then, the operation is proceeded to the step S'12 and the work tube 115 having applied with the first bending is moved, while being seized by the chuck 102 of the chuck means in the second unit bending device, to the region of the bending means and the securing and the holding means in the second unit bending device.

Then, the operation is returned to the step S'2 and the same steps as already explained are executed by the second bending device to apply second bending at the second working position of the work tube 115. Further, third bending fabrication is applied at the third working position to the work tube 115 having applied with the second bending.

In the third step, since it is judged YES in the step S'6, the operation is proceeded to the step S'13 in which the chuck 102 is released and the work tube 115 having applied with the first through third bending is supplied to the product receiver 118.

In each of the embodiment described above, a device for checking work tube 15, 115 may be disposed to the feeder 17, 117 for applying the first bending in this portion. In this, the control means is so set to displace the steps of bending successively.

In the foregoings, bending working has been explained with respect to one work tube 15, 115, a plurality of work tubes 15, 115 are successively supplied from the feeder 17, 117. Then, bending is applied successively to such work tubes 15, 115 and products completed with bending are successively sent to the product receiver 18, 118.

Since two sets of the receiving rollers and the bending rollers are disposed in the bending means for each of the unit bending devices in the above-mentioned embodiments, it is possible to bend work tubes of different diameters or to apply bending of different radius selectively in each of the steps. The bending range can be set by setting the bending angle stopper 8, 108 to a desired position by the bending angle stopper moving cylinder 7, 107. Further, for the first through third working positions, by previously selecting a desired position and moving the twisting angle stopper 11, 111 by the twisting stopper moving cylinder 12, 112 as described above, the first through third bending directions can be set optionally.

In this embodiments, as has been described, since the chuck means seizes the work tube and transfers the working position at a high accuracy to the working position of the bending means, a mechanism for moving the bending means to the axial direction of the work tube is no more necessary, thereby enabling to provide a method of and an apparatus for bending a metal tube of a small diameter which are simple in the constitution, capable of efficiently applying bending at a high accuracy by setting various kinds of working conditions to work tubes and are advantageous also in view of the production cost.

Although descriptions have been made in the above-mentioned embodiments to a constitution in which three sets of unit bending devices are disposed and two sets of selectable receiving rollers and bending rollers are disposed in each of the unit bending devices, the present invention is not restricted only to such embodiments. For instance, it may be so constituted that five sets of unit bending devices are disposed in which four sets of receiving roller and bending rollers are disposed in each of the unit bending devices, or the unit bending devices are arranged side by side by a number greater than that of the working positions and, after the completion for all of the bending working, the work tubes are merely transferred without applying bending application in the subsequent unit bending devices.

Further, although stoppers are used for the setting of the position, direction and angle of the bending in the illustrated embodiments, they may also be set by a stepping motor, a servo motor or the like.

As has been described above specifically, according to the present invention, since the working positions of a metal tube of a small diameter to be worked can be transferred at a high accuracy to a plurality of working positions while being seized by a chuck means and bending is applied by the bending means moved and set to the working positions, there can be provided a method of and an apparatus for bending a metal tube of a small diameter, capable of applying various kinds of working at a high accuracy to a metal tube of a small diameter to be worked and applying bending in a short period of time by synchronizing each of the operations with tact.

What is claimed is:

1. Apparatus for placing a plurality of bends in each of a plurality of small diameter pipes, said apparatus comprising a first bend station and a plurality of subsequent bend stations disposed such that each said bend station has at least one other of said bend stations adjacent thereto for defining pairs of adjacent bend stations, each said bend station including a for gripping one said pipe substantially at an end thereof and a bender spaced from the chuck, each said bender including a receiving roller and a bending roller movable toward and away from the pipe for selectively engaging and disengaging the pipe, said bending roller being rotatable a selected amount about the receiving roller for bending the pipe around the receiving roller, the chuck of each said subsequent bend station being rotatable for rotating each said pipe to a predetermined bend orientation relative to the bend made by the first bend station, at least one chuck in each said pair of adjacent bend stations being movable in a reciprocatory manner to and from the adjacent bend station in the pair for sequentially transferring each said pipe to the adjacent subsequent bend station after completion of each said bend.

2. Apparatus according to claim 1, wherein the chuck in each said bend station is movable relative to the bender of the respective bend station for axially positioning the pipe relative to the respective bender and thereby enabling placement of each said bend at a predetermined location on the pipe.

3. Apparatus according to claim 1, wherein the spacing between the bender and the respective chuck is different for each of said bend stations.

4. Apparatus according to claim 1, wherein the receiving roller and the bending roller are selectively movable vertically away from the pipe after completion of the bend for enabling transfer of the pipe to the subsequent bend station by one said chuck, and wherein the receiving roller and the bending roller of each said bend station are selectively movable vertically toward the pipe for securely engaging the pipe prior to placing a bend therein.

5. Apparatus according to claim 1, wherein one said subsequent bend station defines a final bend station for placing a final bend in the pipe, said apparatus further comprising a pipe receiver in proximity to the final bend station, the chuck of the final bend station being movable for transferring the pipe in the final bend station to the pipe receiver.

6. Apparatus according to claim 1, wherein each said pipe bender includes a pressing die in proximity to the receiving roller and the bending roller, the pressing die being operative to secure a portion of the pipe while the bending roller is rotating about the receiving roller, the pressing die being selectively movable toward and away from the pipe for enabling transfer of the pipe to the subsequent bend station and for enabling placement of a pipe into the bender of the respective bend station.

7. Apparatus according to claim 1, wherein each said bender includes a plurality of receiving rollers and bending rollers of different respective sizes for enabling placement of differently dimensioned bends by each said bend station.

8. Apparatus according to claim 1, wherein the chuck in the subsequent bend station of each said pair of adjacent bend stations is movable for transferring each said pipe to the subsequent bend station of each said pair of adjacent bend stations.

9. A method for placing a plurality of bends in a pipe, said method utilizing a plurality of bend stations in substantially side by side relationship, such that pairs of adjacent bend stations are defined, each said pair comprising a prior bend station and a subsequent bend station, each said bend station including a chuck for gripping an end of the pipe and a bender spaced from the chuck for engaging and bending the pipe engaged by the associated chuck, each said bender including a receiving roller and a bending roller movable toward and away from the pipe for selectively engaging and disengaging the pipe, said bending roller being rotatable a selected amount about the receiving roller for bending the pipe around the receiving roller, the method comprising the steps of:

a) engaging said pipe with the chuck of one said prior bend station;
b) engaging the pipe in said prior bend station by the associated bender at a selected location on the pipe;
c) operating the bender for bending the pipe in the prior bend station by rotating said bending roller about said receiving roller;
d) moving the chuck of the subsequent bend station to the respective prior bend station;
e) engaging the pipe in the prior bend station with the chuck of the subsequent bend station;
f) disengaging the chuck and the bender of the prior bend station from the pipe;
g) moving the chuck of the subsequent bend station with the bent pipe back to the subsequent bend station for transferring the pipe thereto; and
h) repeating steps b–g for each of said pairs of bend stations.

* * * * *